US010180650B2

(12) United States Patent
Kuribayashi et al.

(10) Patent No.: US 10,180,650 B2
(45) **Date of Patent: *Jan. 15, 2019**

(54) IMAGE FORMING APPARATUS

(71) Applicant: FUJI XEROX CO., LTD., Tokyo (JP)

(72) Inventors: Masataka Kuribayashi, Kanagawa (JP); Masahiro Uchida, Kanagawa (JP); Takafumi Koide, Kanagawa (JP); Yusuke Fukuda, Kanagawa (JP); Katsuyuki Kitajima, Kanagawa (JP); Koji Funaba, Kanagawa (JP); Satomi Hara, Kanagawa (JP); Kana Yoshida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/660,060

(22) Filed: Jul. 26, 2017

(65) Prior Publication Data

US 2018/0275594 A1 Sep. 27, 2018

(30) Foreign Application Priority Data

Mar. 24, 2017 (JP) ..... 2017-059530

(51) Int. Cl.

| | |
|---|---|
| ***G03G 9/08*** | (2006.01) |
| ***G03G 21/00*** | (2006.01) |
| ***G03G 9/087*** | (2006.01) |

(52) U.S. Cl.

CPC ..... *G03G 21/0011* (2013.01); *G03G 9/0819* (2013.01); *G03G 9/0821* (2013.01); *G03G 9/08755* (2013.01)

(58) Field of Classification Search

CPC ..... G03G 21/0011; G03G 21/0029

See application file for complete search history.

(56) References Cited

U.S. PATENT DOCUMENTS

| | | | | |
|---|---|---|---|---|
| 6,013,406 | A * | 1/2000 | Moriki | G03G 9/0821 430/108.22 |
| 7,720,400 | B2 * | 5/2010 | Taguchi | G03G 15/161 399/101 |
| 2014/0255839 | A1 * | 9/2014 | Taguchi | G03G 9/09733 430/105 |

FOREIGN PATENT DOCUMENTS

| | | |
|---|---|---|
| JP | 2004-170440 A | 6/2004 |
| JP | 2014-056126 A | 3/2014 |

* cited by examiner

*Primary Examiner* — Ryan D Walsh
(74) *Attorney, Agent, or Firm* — Oliff PLC

(57) ABSTRACT

An image forming apparatus includes an image holding member, a charging unit; an electrostatic image forming unit, a development unit, a transfer unit; a fixing unit, and a cleaning unit. A toner for electrostatic image development contains a binder resin containing an amorphous resin and a crystalline resin, and paraffin wax. The toner has a volume-average particle diameter of 6 μm to 9 μm, a shape factor SF1 of 140 or more, and a toluene insoluble content within a range of 25% to 40%. The melting temperature of the paraffin wax is 60° C. or more and 80° C. or less. The absolute value of difference between the melting temperature of the crystalline resin and the melting temperature of the paraffin is 10° C. or less.

9 Claims, 3 Drawing Sheets

IMAGE FORMING APPARATUS

CROSS-REFERENCE TO RELATED APPLICATIONS

This application is based on and claims priority under 35 USC 119 from Japanese Patent Application No. 2017-059530 filed Mar. 24, 2017.

BACKGROUND (i) Technical Field

The present invention relates to an image forming apparatus.

(ii) Related Art

An image is formed by an electrophotographic method including charging the entire surface of a photoreceptor, forming an electrostatic image by exposing the surface of the photoreceptor to a laser beam according to image information, then forming a toner image by developing the electrostatic image with a developer containing a toner, and finally transferring and fixing the toner image to the surface of a recording medium.

SUMMARY

In an image forming apparatus including a cleaning unit that cleans a toner remaining untransferred on the surface of an image holding member by scraping the toner with a cleaning blade pressed on the image holding member, cleaning properties tend to be decreased by using a toner for electrostatic image development, which contains a binder resin containing an amorphous resin and a crystalline resin, toner particles containing paraffin wax having a melting temperature of 60° C. or more and 80° C. or less, and an external additive, and in which an absolute value of difference between the melting temperature of the crystalline resin and the melting temperature of the paraffin wax is 10° C. or less, the volume average particle diameter of the toner particles is 6 μm or more and 9 μm or less, the shape factor SF1 of the toner particles is 140 or more, and the toluene insoluble content in the toner for electrostatic image development is 25% by mass and 45% by mass or less.

According to an aspect of the invention, there is provided an image forming apparatus including an image holding member, a charging unit that charges the surface of the image holding member, an electrostatic image forming unit that forms an electrostatic image on the surface of the charged image holding member, a development unit that contains an electrostatic image developer containing a toner for an electrostatic image development and develops a toner image on the surface of the image holding member, a transfer unit that transfers the toner image to a recording medium, a fixing unit that fixes the toner image to the recording medium, and a cleaning unit including a cleaning blade and a member that dams the toner for electrostatic image development scraped from the surface of the image holding member and stores the toner on the upstream side of a contact position between the cleaning blade and the image holding member in the rotational direction of the image holding. In the image forming apparatus, the toner for electrostatic image development contains a binder resin containing an amorphous resin and a crystalline resin, and paraffin wax, the toner has a volume-average particle diameter of 6 μm to 9 μm, a shape factor SF1 of 140 or more, and a toluene insoluble content within a range of 25% to 40%, the melting temperature of the paraffin wax is 60° C. or more and 80° C. or less, and an absolute value of difference between the melting temperature of the crystalline resin and the melting temperature of the paraffin wax is 10° C. or less.

BRIEF DESCRIPTION OF THE DRAWINGS

An exemplary embodiment of the present invention will be described in detail based on the following figures, wherein.

DETAILED DESCRIPTION

Figure 1:
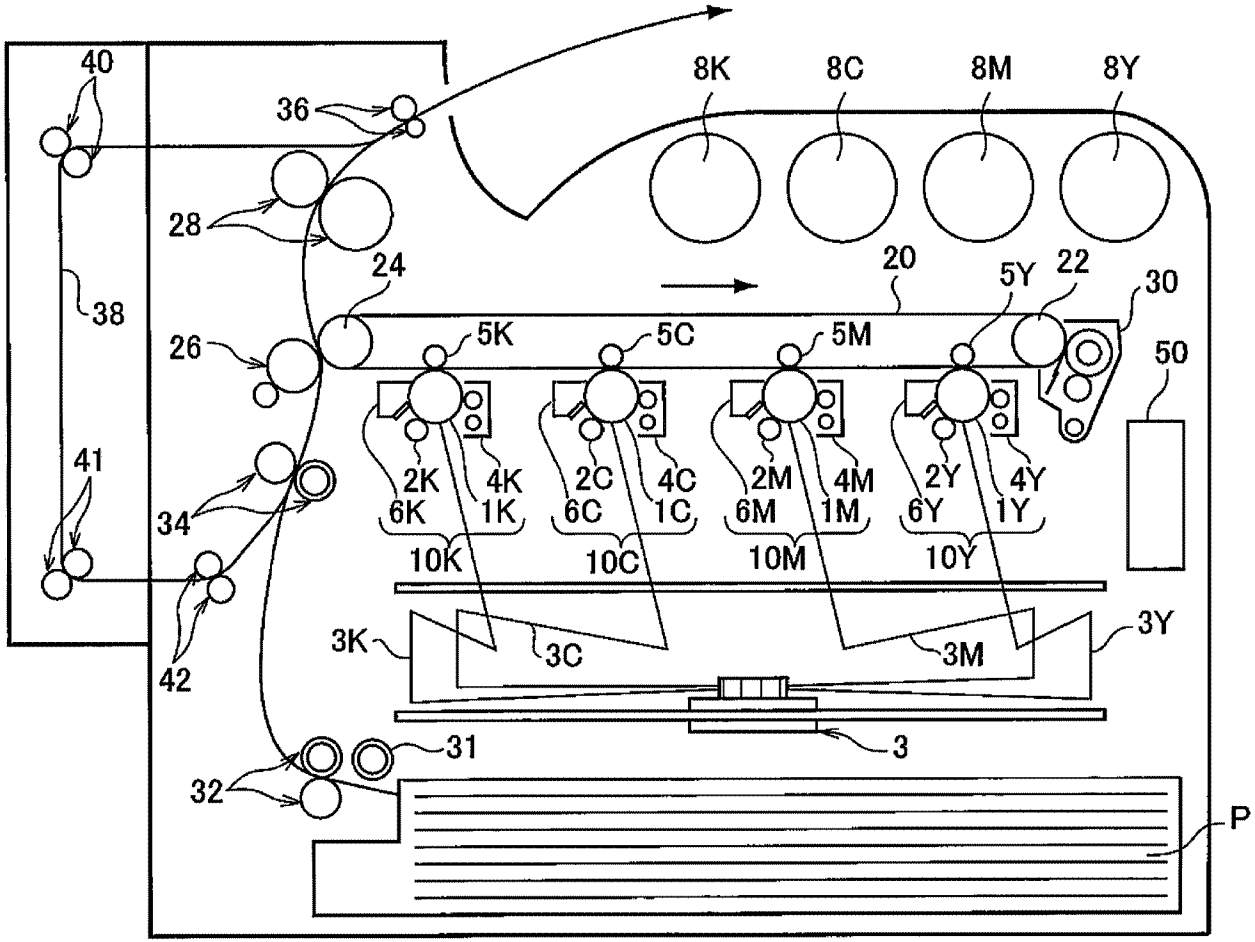
FIG. 1 is a schematic configuration diagram showing an example of an image forming apparatus according to an exemplary embodiment of the present invention.

An exemplary embodiment of the present invention is described in detail below.

[Image Forming Apparatus]

An image forming apparatus according to an exemplary embodiment of the present invention includes an image holding member, a charging unit that charges the surface of the image holding member, an electrostatic image forming unit that forms an electrostatic image on the surface of the charged image holding member, a development unit that contains an electrostatic image developer containing a toner for electrostatic image development (simply referred to as a "toner" hereinafter) and develops, as a toner image, the electrostatic image formed on the surface of the image holding member with the electrostatic image developer, a transfer unit that transfers the toner image formed on the surface of the image holding member to the surface of a recording medium, a fixing unit that fixes the toner image transferred to the surface of the recording medium, and a cleaning unit that is disposed on the surface of the image holding member before charging by the charging unit and after transfer of the toner image to the surface of the recording medium by the transfer unit. The cleaning unit includes a cleaning blade that cleans by scraping the toner for electrostatic image development remaining untransferred on the surface of the image holding member, and a damming member that dams the toner for electrostatic image development scraped from the surface of the image holding member and stores the toner on the upstream side of a contact position between the cleaning blade and the image holding member in the rotational direction of the image holding member.

The toner contains a binder resin containing an amorphous resin and a crystalline resin, toner particles containing paraffin wax having a melting temperature of 60° C. or more and 80° C. or less, and an external additive. The absolute value of difference between the melting temperature of the crystalline resin and the melting temperature of the paraffin wax is 10° C. or less, the volume-average particle diameter of the toner particles is 6 μm or more and 9 μm or less, the shape factor SF1 of the toner particles is 140 or more, and the toluene insoluble content in the toner for electrostatic image development is 25% by mass or more and 45% by mass or less.

The toluene insoluble content of 25% by mass or more and 45% by mass or less in the toner represents that the toner properly contains a crosslinked resin. That is, the toluene insoluble content is an index of the content of the crosslinked resin in the toner.

The shape factor SF1 of 140 or more of the toner particles represents an irregular shape. The shape factor SF1 of 140 or more represents that the toner particles having an irregular shape are pulverized toner particles generally produced by a pulverizing method (for example, a kneading/pulverizing method).

In addition, the volume-average particle diameter of 6 μm or more and 9 μm or less of the toner particles represents that the toner particles are relatively small particles.

The toner according to the exemplary embodiment having the characteristics described above may be referred to as the "specific pulverized toner" or simply the "toner" in the description below.

An electrophotographic image forming apparatus generally uses a cleaning system in which a toner remaining untransferred on the surface of an image holding member is cleaned by a cleaning blade (simply referred to as a "blade" hereinafter). The cleaning system is a system in which the blade having elasticity is pressed on the image holding member to scrape residual toner from the surface of the image holding member in a contact portion (cleaning nip part) between the blade and the image holding member.

On the other hand, when a toner containing an external additive externally added to toner particles is applied to the image forming apparatus, the external additive is separated from the toner particles by, for example, the influence of external force such as mechanical load during stirring in a development unit, mechanical load due to scraping in the cleaning nip part, and the like. In addition, the toner particles are dammed at the end of the cleaning nip part (a region, which is also referred to as a pre-nip region" hereinafter, on the upstream side of the contact portion between the blade and the image holding member in the rotational direction of the image holding member), forming aggregates (referred to as a "toner dam" hereinafter) due to aggregation by the pressure applied from the blade. Further, when reaching the cleaning nip part, the separated external additive is dammed at a position nearer to the contact portion between the blade and the image holding member than the toner dam, forming aggregates (hereinafter referred to as an "external additive dam") due to aggregation by the pressure applied from the blade. The external additive dam improves the cleaning properties (toner scraping properties).

For example, in order to achieve low-temperature fixing, the toner used may contain a crystalline resin as a binder resin and paraffin wax having a melting temperature of 60° C. or more and 80° C. or less as a wax. Also, for example, in order to achieve improvements in the transfer in a transfer unit and the cleaning properties of the cleaning blade, the toner used may be a pulverized toner containing the external additive externally added to pulverized toner particles. The pulverized toner particles are generally formed by mixing the binder resin, a coloring agent, wax, etc., and then pulverizing the resultant mixture. Thus, the production method generates the pulverized toner having an irregular shape and causes the crystalline resin and the wax (that is, a release agent) to be easily exposed from the surfaces of the pulverized toner particles. In addition, the exposed crystalline resin and wax are relatively soft as compared with other components, and thus the external additive externally added to the pulverized toner is easily buried in the surfaces of the pulverized toner particles, thereby easily changing the external additive structure in the pulverized toner. Also, the durability as the toner is hardly secured.

When the pulverized toner containing the external additive externally added to the pulverized toner particles is applied to the image forming apparatus, the cleaning properties are easily degraded. A conceivable reason for this is as follows.

The pulverized toner particles have the properties described above, that is, the external additive is easily buried in the surfaces of the pulverized toner particles and is thus hardly separated from the pulverized toner even by the external force applied by a mechanical load or the like in the cleaning nip part when the toner remaining on the surface of the image holding member is scraped. Therefore, the external additive hardly reaches the end (pre-nip region) of the cleaning nip part, and the amount of the external additive supplied to the end is hardly stabilized. In addition, with the external additive dam formed by a relatively small amount of the external additive, lubricity is hardly secured, and dam strength is easily weakened, thereby easily causing breakage of the dam.

For the reasons described above, when the pulverized toner containing the external additive externally added thereto is applied to the image forming apparatus, the cleaning properties are considered to be easily decreased. A decrease in the cleaning properties causes the problem of causing toner filming on the surface of the image holding member.

On the other hand, the image forming apparatus according to the exemplary embodiment has a configuration in which the cleaning unit provided with the damming member for damming the toner scraped from the surface of the image holding member is combined with the specific pulverized toner. Thus, the image forming apparatus with good cleaning properties can be realized.

The reason for this is unknown, but the estimated reason is as follows.

Figure 2:
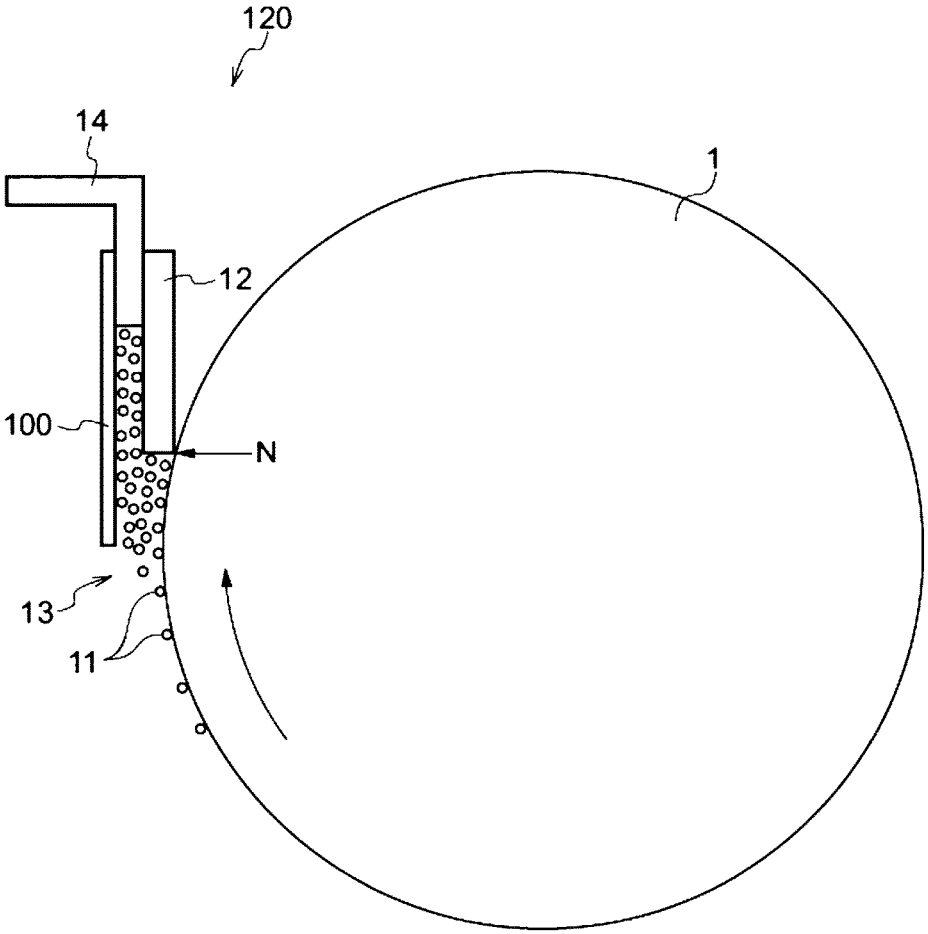
FIG. 2 is a schematic configuration diagram showing an installation form of a cleaning unit according to an exemplary embodiment of the present invention.

FIG. 2 is a schematic configuration diagram showing an example of the installation form of the cleaning unit according to the exemplary embodiment.

As shown in FIG. 2, a cleaning unit 120 includes a L-shaped support member 14, a cleaning blade 12 disposed at the end of the support member 14 on the side near to an electrophotographic photoreceptor (referred to as a "photoreceptor") 1 (an example of the image holding member), and a damming member 100 disposed at the end of the support member 14 on the side (also referred to as the "back side of the cleaning blade 12") opposite to the cleaning blade 12. In the exemplary embodiment, the width (length in the axial direction of the photoreceptor) of the damming member 100 in the longitudinal direction is adjusted to be substantially the same length as the width of the cleaning blade 12 in the longitudinal direction.

The end of the cleaning blade 12 faces in the direction opposite to the rotational direction (arrow direction) of the photoreceptor 1, and in this state, the cleaning blade 12 is in contact with the surface of the photoreceptor 1.

During rotational drive of the photoreceptor 1, a cleaning nip part (referred to as a "nip part" hereinafter) N is formed by the dynamic friction force produced between the surface of the photoreceptor and the end of the cleaning blade 12. When the photoreceptor 1 is rotationally driven, the toner (in the exemplary embodiment, the specific pulverized toner) 11 remaining untransferred is supplied to the nip part N, forming a toner reservoir 13 surrounded by the damming member 100, the cleaning blade 12, and the surface of the photoreceptor 1 on the upstream side in the rotational direction of the photoreceptor 1. In more detail, toner aggregates (toner dam) are formed by a portion of the toner particles in the pre-nip region. In addition, an external additive dam is formed in the pre-nip region by the external additive separated from the toner 11 at a position nearer to the contact portion between the cleaning blade 12 and the photoreceptor 1.

As described above, the toner according to the exemplary embodiment is the pulverized toner (specific pulverized toner) having specific characteristics, and thus the crystalline resin and the wax, which are relatively soft, are easily exposed from the surfaces due to the production method thereof, thereby making the external additive difficult to separate from the pulverized toner. However, in the cleaning unit 120 according to the exemplary embodiment, the damming member 100 is disposed on the rear side of the cleaning blade 12, thereby easily increasing the whole amount of the specific pulverized toner stored on the upstream side (upstream side in the rotational direction of the image holding member) of the pre-nip region where the toner damp is formed. Therefore, the supply source of the toner particles to the toner dam and the supply source of the external additive to the external additive dam are increased. This easily increases the amount of the external additive reaching the end (pre-nip region) of the nip part N. That is, the external additive dam is easily stably formed at the end of the nip part N, and lubricity in the nip part N is secured. Further, the external additive dam is stably formed, and thus the strength of the external additive dam is enhanced and the external additive dam is hardly broken.

Therefore, according to the exemplary embodiment, the image forming apparatus with the good cleaning properties is realized by a configuration in which the cleaning unit 120 provided with the damming member 100 is combined with the specific pulverized toner.

Also, the specific pulverized toner according to the exemplary embodiment is often used for the purpose of low-temperature fixing, and thus the image forming apparatus according to the exemplary embodiment can be used as an image forming apparatus particularly for the purpose of low-temperature fixing.

Examples of an apparatus used as the image forming apparatus according to the exemplary embodiment include known image forming apparatus, such as an apparatus of a direct-transfer system in which the toner image formed on the surface of the image holding member is directly transferred to the recording medium, an apparatus of an intermediate-transfer system in which the toner image formed on the surface of the image holding member is first transferred to an intermediate transfer body, and the toner image transferred to the intermediate transfer body is second transferred to the surface of the recording medium; an apparatus including an elimination unit which eliminates charge by irradiating the surface of the image holding member with eliminating light before charging and after transfer of the toner image, and the like.

In the case of an apparatus of an intermediate-transfer system, a configuration applied to the transfer unit includes, for example, an intermediate transfer body to which the toner image is transferred to the surface thereof, a first transfer unit which transfers the toner image formed on the surface of the image holding member to the surface of the intermediate transfer body, and a second transfer unit which transfers the toner image transferred to the surface of the intermediate transfer body to the surface of the recording medium.

An example of the image forming apparatus according to the exemplary embodiment is described below with reference to the drawings. However, principal portions shown in the drawings are described, and description of other portions is omitted.

FIG. 1 is a schematic configuration diagram showing an example of the image forming apparatus according to the exemplary embodiment of the present invention.

An image forming apparatus shown in FIG. 1 includes first to fourth image forming units 10Y, 10M, 10C, and 10K of an electrophotographic system which output images of colors of yellow (Y), magenta (M), cyan (C), and black (K), respectively, based on color separation image data. The image forming units (simply referred to as "units" hereinafter) 10Y, 10M, 10C, and 10K are disposed in parallel at predetermined distances therebetween in a horizontal direction. The units 10Y, 10M, 10C, and 10K may be process cartridges detachable from the image forming apparatus.

An intermediate transfer body 20 is provided above the units 10Y, 10M, 10C, and 10K as shown in the drawing so as to pass through the units. The intermediate transfer body 20 is wound on a driving roll 22 and a support roll 24 in contact with the inner side of the intermediate transfer body 20, which are disposed at a distance therebetween in the lateral direction of the drawing, so that the intermediate transfer body 20 moves in a direction from the first unit 10Y to the fourth unit 10K. The support roll 24 is applied with force by a spring or the like (not shown) in a direction away from the driving roll 22, and tension is applied to the intermediate transfer body 20 wound around both rolls. Also, an intermediate transfer body cleaning device 30 is provided on the image holding side of the intermediate transfer body 20 so as to face the driving roll 22.

In addition, four color toners of yellow, magenta, cyan, and black contained in toner cartridges 8Y, 8M, 8C, and 8K, respectively, are supplied to developing devices 4Y, 4M, 4C, and 4K of the units 10Y, 10M, 10C, and 10K, respectively.

The first to fourth units 10Y, 10M, 10C, and 10K have the same configuration, and thus the first unit 10Y that forms a yellow image and is disposed on the upstream side in the traveling direction of the intermediate transfer body is described as a representative. The description of the second to fourth units 10M, 10C, and 10K is omitted by adding reference numerals with magenta (M), cyan (C), and black (K) in place of yellow (Y) to portions equivalent to those of the first unit 10Y.

The first unit 10Y includes a photoreceptor 1Y functioning as an image holding member. Around the photoreceptor 1Y, there are sequentially provided a charging device 2Y that charges the surface of the photoreceptor 1Y to a predetermined potential, an electrostatic image forming device 3 that forms an electrostatic image by exposure of the charged surface with light 3Y based on an image signal obtained by color separation, a developing device 4Y that develops the electrostatic image by supplying a charged toner to the electrostatic image, a first transfer device 5Y that transfers the developed toner image to the intermediate transfer body 20, and a photoreceptor cleaning device 6Y that removes the toner remaining on the surface of the photoreceptor 1Y after first transfer.

The first transfer device 5Y is disposed on the inside of the intermediate transfer body 20 and is provided at a position facing the photoreceptor 1Y. Further, a bias power supply (not shown) is connected to each of the first transfer rollers 5Y, 5M, 5C, and 5K in order to apply a first transfer bias thereto. The transfer bias applied to each of the first transfer devices from the bias power supply can be changed.

An example of the operation of forming a yellow image in the first unit 10Y is described below.

First, before the operation, the surface of the photoreceptor 1Y is charged by the charging device 2Y.

The light 3Y is output to the surface of the charged photoreceptor 1Y by the electrostatic image forming device 3 according to yellow image data. The surface of the photoreceptor 1Y is irradiated with the light 3Y, thereby forming an electrostatic image in a yellow image pattern on the surface of the photoreceptor 1Y.

The electrostatic image formed on the photoreceptor 1Y is rotated to a predetermined development position with travel of the photoreceptor 1Y. Then, at the development position, the electrostatic image on the photoreceptor 1Y is visualized as a toner image (developed image) by the developing device 4Y. Specifically, when the surface of the photoreceptor 1Y is passed through the developing device 4Y, the yellow toner electrostatically adheres to an electrostatically eliminated electrostatic image on the surface of the photoreceptor 1Y, developing the electrostatic image with the yellow toner. Then, the photoreceptor 1Y on which the yellow toner image has been formed is continuously traveled at a predetermined speed, and the toner image developed on the photoreceptor 1Y is conveyed to a predetermined first transfer position.

When the yellow toner image on the photoreceptor 1Y is conveyed to the first transfer position, the first transfer bias is applied to the first transfer device 5Y, and electrostatic force to the first transfer device 5Y from the photoreceptor 1Y is applied to the toner image. Thus, the toner image on the photoreceptor 1Y is transferred to the intermediate transfer body 20. On the other hand, the toner remaining on the photoreceptor 1Y is removed by the photoreceptor cleaning device 6Y and recovered.

Then, the intermediate transfer body 20 to which the yellow toner image has been transferred in the first unit 10Y is sequentially conveyed through the second to fourth units 10M, 10C, and 10K to superpose the toner images of the respective colors by multi-layer transfer.

Next, the intermediate transfer body 20 to which the four color toner images have been transferred in multiple layers through the first to fourth units is reached to a second transfer part configurated by the intermediate transfer body 20, the support roll 24 in contact with the inner side of the intermediate transfer body 20 and the second transfer device 26 disposed on the image holding surface side of the intermediate transfer body 20. Meanwhile, the recording paper (recording medium) P is fed with predetermined timing, through a feeding mechanism, to a space in which the second transfer device 26 is in contact with the intermediate transfer body 20 and a second transfer bias is applied to the support roll 24. The applied transfer bias has the same polarity as the polarity of the toner and electrostatic force acting toward the recording paper P from the intermediate transfer body 20 is applied to the toner image to transfer the toner image on the intermediate transfer body 20 to the recording paper P.

The recording paper P is taken up by a take-up roll (pick-up roll) 31 from the state of being stored in a recording paper container, conveyed by a pair of conveyance rolls 32, and then supplied to the second transfer part with predetermined timing by a pair of positioning rolls (pair of register rolls) 34.

Then, the recording paper P is sent to a fixing device 28 and the toner image is fixed to the recording paper P, forming a fixed image.

The recording paper P after the completion of fixing of the color image is conveyed to a discharge part by a pair of discharge rolls 36, and a series of color image forming operations is finished.

On the other hand, in the case of double-sided printing, the recording paper P is reversed and conveyed (switch-backed) by the pair of discharge rolls 36, again conveyed to the pair of positioning rolls through a conveyance passage 38 for double-sided printing, which is configurated by pairs of conveyance rolls 40, 41, and 42, and supplied to the second transfer part. The recording paper P having the toner image transferred to the back surface thereof is then sent to the fixing device 28 in which the toner image is fixed to the recording paper P, thereby forming a fixed image. Then, the recording paper P after the completion of fixing of the color image is conveyed to the discharge part by the pair of discharge rolls 36.

The image forming apparatus shown in FIG. 1 includes a controller 50 that controls the operation of each of the devices (or each of the portions of each device). In addition, each of the operations of the image forming apparatus shown in FIG. 1 is controlled by the controller 50. That is, each of the operations of the image forming apparatus shown in FIG. 1 is performed by a control program executed in the controller 50.

Details of a typical configuration of the image forming apparatus shown in FIG. 1 are described below. In the description, symbols of "Y", "M", "C", and "K" are omitted.

<Photoreceptor>

The photoreceptor 1 has, for example, a conductive substrate, an undercoat layer formed on the conductive substrate, and a photosensitive layer formed on the undercoat layer. The photosensitive layer may have a two-layer structure including a charge generation layer and a charge transport layer. The photosensitive layer may be either an organic photosensitive layer or an inorganic photosensitive layer. The photoreceptor 1 may include a protective layer provided on the photosensitive layer.

<Charging Device>

The charging device 2 is provided, for example, in contact or non-contact with the surface of the photoreceptor 1, and although not shown in the drawing, a charging member that charges the surface of the photoreceptor 1 and a power supply that applies a charging voltage to the charging member are provided. The power supply is electrically connected to the charging member.

Examples of the charging member of the charging device 2 include contact-type chargers using a conductive charging roller, a charging brush, a charging film, a charging rubber blade, a charging tube, and the like. Also, other examples of the charging member include known chargers such as a non-contact type roller charger, a scorotron charger or corotron charger using corona charge, and the like.

<Electrostatic Image Forming Device>

The electrostatic image forming device 3 is, for example, an optical device that exposes the surface of the photoreceptor 1 to light such as a semiconductor laser beam, LED light, liquid crystal shutter light, or the like in a determined image pattern. The wavelength of a light source is within the spectral sensitivity region of the photoreceptor 1. The wavelength of a semiconductor laser is generally near infrared having an oscillation wavelength near 780 nm. However, the wavelength is not limited to this, and a laser having an oscillation wavelength of the 600-nm level, or a laser as a blue laser having an oscillation wavelength of 400 nm or more and 450 nm or less may be used. Also, a surface emission-type laser light source of a type capable of emitting multiple beams is effective for forming a color image.

<Developing Device>

The developing device 4 is provided, for example, on the downstream side, in the rotational direction of the photoreceptor 1, of the irradiation position of the light 3 from the electrostatic image forming device 3. The developing device 4 includes a housing part (not shown) provided therein so as to house the developer. The housing part houses the electrostatic image developer containing the specific pulverized toner (toner).

Although not shown in the drawings, the developing device 4 include, for example, a development member that develops the electrostatic image, which is formed on the surface of the photoreceptor 1, with the developer containing the toner, and a power supply that applies a development voltage to the development member. The development member is, for example, electrically connected to the power supply.

The development member of the developing device 4 is selected according to the type of the developer and is, for example, a development roller having a development sleeve including a built-in magnet.

In the developing device 4, for example, the development voltage is applied to the development member, and the development member applied with the development voltage is charged to a development potential corresponding to the development voltage. For example, the development member charged to the development potential holds, on the surface thereof, the developer stored in the developing device 4 and supplies the toner contained in the developer to the surface of the photoreceptor 1 from the inside of the developing device 4.

The toner supplied to the photoreceptor 1, for example, electrostatically adheres to the electrostatic image on the photoreceptor 1. In detail, the toner contained in the developer is supplied to a region of the photoreceptor, where the electrostatic image has been formed, by, for example, a potential difference in a region where the photoreceptor 1 faces the development member of the developing device 4, that is, a potential difference between the surface potential of the photoreceptor 1 and the development potential of the development member of the developing device 4 in the region. When the developer contains a carrier, the carrier is returned to the developing device 4 while being maintained in the development member.

<First Transfer Device>

The first transfer device 5 is provided, for example, on the downstream side of the installation positon of the developing device 4 in the rotational direction of the photoreceptor 1. Although not shown in the drawings, the first transfer device 5 includes, for example, a transfer member that transfers the toner image formed on the photoreceptor 1 to the intermediate transfer body 20, and a power supply that applies a transfer voltage to the transfer member. The transfer member has, for example, a cylindrical shape, and is provided to hold the intermediate transfer body 20 between the transfer member and the photoreceptor 1. The transfer member is, for example, electrically connected to the power supply.

Examples of the transfer member of the first transfer device 5 include contact-type transfer chargers using a belt, a roller a film, a rubber blade, or the like, and non-contact type transfer chargers such as a scorotron transfer charger or corotron transfer charger using corona charge, and the like.

<Intermediate Transfer Body>

A belt-shaped member (intermediate transfer belt) containing polyimide, polyamide-imide, polycarbonate, polyarylate, polyester, rubber or the like, which is imparted with semiconductivity, is used as the intermediate transfer body 20. Also, the form of the intermediate transfer body 20 may be a drum-shape member other than the belt-shaped member.

<Second Transfer Device>

Although not shown in the drawings, the second transfer device 26 includes, for example, a transfer member that transfers the toner image formed on the intermediate transfer body 20 to the recording paper P, and a power supply that applies a transfer voltage to the transfer member. The transfer member has, for example, a cylindrical shape, and is provided to hold the recording paper P between the transfer member and the intermediate transfer body 20. The transfer member is, for example, electrically connected to the power supply.

Examples of the transfer member of the second transfer device 26 include contact-type transfer chargers using a belt, a roller, a film, a rubber blade, or the like, and non-contact type transfer chargers such as a scorotron transfer charger or corotron transfer charger using corona charge, and the like.

<Photoreceptor Cleaning Device>

The photoreceptor cleaning device 6 is provided on the downstream side of the first transfer device 5 in the rotational direction of the photoreceptor 1. The photoreceptor cleaning device 6 cleans the residual toner adhering to the photoreceptor 1 after the toner image is transferred to the intermediate transfer body 20. The photoreceptor cleaning device 6 cleans adhered substances such as paper dust and the like other than the residual toner.

The photoreceptor cleaning device 6 according to the exemplary embodiment includes a cleaning unit having a cleaning blade in contact with the surface of the photoreceptor 1 to clean by scraping the toner remaining untransferred on the surface of the photoreceptor 1, and a damming member that dams the toner scraped from the surface of the photoreceptor 1.

The cleaning unit is described in detail later.

<Fixing Device>

The fixing device 28 is provided on the downstream side of the second transfer region of the second transfer device 26 in the conveyance direction of the recording paper P. The fixing device 28 is, for example, a known fixing unit, for example, a heat roller fixing unit, an oven fixing unit, or the like.

(Cleaning Unit)

The photoreceptor cleaning device 6 includes a cleaning unit 120 shown in FIG. 2.

FIG. 2 is a schematic configuration diagram showing an installation form of the cleaning unit 120 according to exemplary embodiment.

The cleaning unit 120 includes a L-shape support member 14, a cleaning blade 12 disposed at the photoreceptor-side end of the support member 14, and a damming member 100 disposed at the end of the support member 14 on the back side of the cleaning blade 12.

The support member 14 is fixed to a cleaner housing (not shown) by a fixing unit.

The cleaning unit 120 may include a known member other than the cleaning blade 12, the damming member 100, and the support member 14 which supports them.

—Cleaning Blade—

The cleaning blade 12 is a member that cleans by scraping the toner remaining untransferred on the surface of the photoreceptor 1.

Also, the cleaning blade 12 is a plate-shaped member having elasticity.

Examples of the material constituting the cleaning blade 12 include elastic materials such as silicone rubber, fluorocarbon rubber, ethylene-propylene-diene rubber, polyurethane rubber, and the like. Among these, polyurethane rubber is preferred because of excellent mechanical properties such as abrasion resistance, chipping resistance, creep resistance, and the like.

The pressing pressure N of the cleaning blade 12 to the photoreceptor 1 is set to 0.6 gf/mm$^2$ or more and 6.0 gf/mm$^2$ or less.

The pressing pressure N is the pressing pressure (gf/mm$^2$) at which the cleaning blade 12 presses toward the center of the photoreceptor 1 at a position of contact with the photoreceptor 1.

—Support Member—

The support member 14 is a member that supports the cleaning blade 12 and the damming member 100. The support member 14 allows the cleaning blade 12 to press the photoreceptor 1 under the pressing pressure N.

Examples of the material constituting the support member 14 include metal materials such as aluminum, stainless, and the like.

In the exemplary embodiment, the shape of the support member 14 is a L-like shape, but the shape is not limited to this.

In addition, an adhesive layer containing an adhesive or the like for bonding two members may be provided between the support member 14 and the cleaning blade 12 and between the support member 14 and the damming member 100.

(Damming Member)

The damming member 100 is a member that dams the toner scraped from the surface of the photoreceptor 1 and stores the toner on the upstream side of the contact position between the cleaning blade 12 and the photoreceptor 1 in the rotational direction (in FIG. 2, an arrow direction) of the photoreceptor 1.

The material of the damming member 100 is not particularly limited, but a resin is preferred.

Examples of the resin include polyethylene terephthalate, polyethylene, polypropylene, polyurethane, and the like. Among these, polyethylene terephthalate is preferred.

Examples of the shape of the damming member 100 include, but are not particularly limited to, a film shape, a sheet shape, and a plate shape. Among these, a film shape is preferred.

The thickness of the damming member 100 is preferably 20 μm or more and 150 μm or less, more preferably 30 μm or more and 100 μm or less, and even more preferably 30 μm or more and 70 μm or less.

The length (length in the axial direction of the photoreceptor) of the damming member 100 in the longitudinal direction thereof is adjusted to be substantially the same length as the width of the cleaning blade 12 in the longitudinal direction.

The damming member 100 may have openings.

Therefore, the toner stored in the toner reservoir 13 by the damming member 100 partially passes through the openings, and thus the toner is easily replaced. This suppresses the aggregation of toner particles and the aggregation of the external additive, thereby easily improving the cleaning properties.

The shape of the openings is not particularly limited.

Examples of the shape of the openings include a polygonal shape, a circular shape, and an elongated hole shape (slit shape).

Also, the number and position of openings are not particularly limited. A preferred position where the openings are formed is a position corresponding to at least one of the nip part N and the pre-nip region in the transverse direction of the damming member 100. In addition, openings are preferably formed at predetermined intervals over the entire region in the longitudinal direction.

An example of the damming member having an opening is described below.

Figure 3:
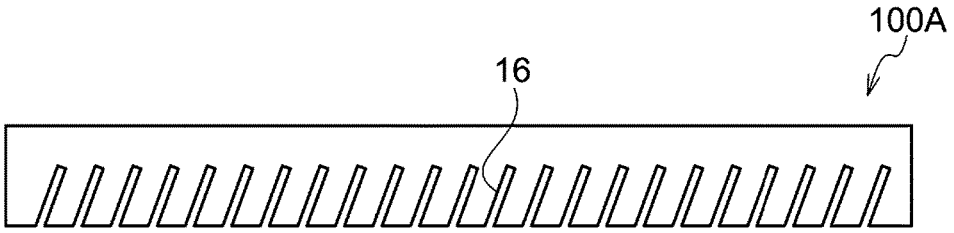
FIG. 3 a schematic diagram showing an example of a damming member having openings according to an exemplary embodiment of the present invention.
Figure 4:
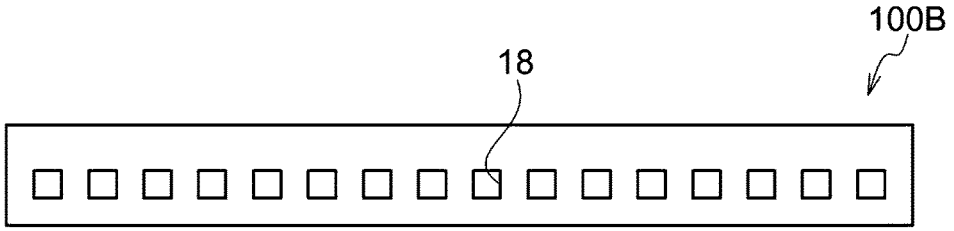
FIG. 4 a schematic diagram showing an example of a damming member having openings according to an exemplary embodiment of the present invention.

FIGS. 3 and 4 each show an example of the damming member having openings.

A damming member 100A shown in FIG. 3 has plural elongated holes (slits) 16 (an example of openings) provided at certain intervals over the entire region in the longitudinal direction (axial direction of the photoreceptor). Also, the elongated holes 16 are provided in a region containing a position corresponding to at least one of the nip part N and the pre-nip region in the transverse direction.

A damming member 100B shown in FIG. 4 has plural rectangular holes 18 (an example of openings) provided at certain intervals over the entire region in the longitudinal direction (axial direction of the photoreceptor). Also, the rectangular holes 18 are provided in a region containing a position corresponding to at least one of the nip part N and the pre-nip region in the transverse direction.

In addition, both the damming members 100A and 100B shown in FIGS. 3 and 4, respectively, are film-shaped damming members.

Next, the function of the cleaning unit 12 is described.

As shown in FIG. 2, when the photoreceptor 1 is rotationally driven in the arrow direction, the toner remaining untransferred is supplied to the nip part N, forming the toner reservoir 13 surrounded by the damming member 100, the cleaning blade 12, and the surface of the photoreceptor 1 on the upstream side in the rotational direction of the photoreceptor 1.

The cleaning unit 120 has the damming member 100 disposed on the back side of the cleaning blade 12, and thus the whole amount of the toner stored in the toner reservoir 13 is easily increased as compared with the case without the damming member 100. This results in easy increases in the supply source of toner particles to the toner dam (not shown) and the supply source of the external additive to the external additive dam (not shown) formed nearer to the contact portion of the photoreceptor 1 than the toner dam.

The image forming apparatus according to the exemplary embodiment is provided with the photoreceptor cleaning device 6 having the cleaning unit 120, and thus the external additive dam is easily formed at the end of the nip part N, and lubricity in the nip part N is secured. Therefore, the cleaning properties are improved.

For example, when the cleaning unit 120 has the damming member 100A or 100B having openings as the damming member 100, the toner stored in the toner reservoir 13 is easily replaced, thereby suppressing aggregation of the toner particles and aggregation of the external additive and easily improving the cleaning properties. Also, even when a carrier and foreign substances are mixed in the toner reservoir 13, the carrier and foreign substances are easily discharged because the damming member 100 has openings.

<Toner for Electrostatic Image Development>

In the image forming apparatus according to the exemplary embodiment, the developer housed in the development unit contains the specific pulverized toner (toner).

The toner contains toner particles containing a binder resin, which contains an amorphous resin and a crystalline resin, and paraffin wax having a melting temperature of 60° C. or more and 80° C. or less, and the external additive.

(Toluene Insoluble Content)

The toner according to the exemplary embodiment has a toluene insoluble content of 25% by mass or more and 45% by mass or less. The toluene insoluble content is an index of the content of a crosslinked resin contained in the toner.

The toluene insoluble content is preferably 28% by mass or more and 38% by mass or less and more preferably 30% by mass or more and 35% by mass or less.

With the toluene insoluble content of 25% by mass or more, the excellent cleaning properties can be achieved, and burying of the external additive can be suppressed.

With the toluene insoluble content of 45% by mass or less, the excellent cleaning properties can be achieved.

The toluene insoluble content can be adjusted by, for example, the following method: 1) a method of forming a crosslinked structure or a branched structure by adding a crosslinking agent to a polymer component having a reactive functional group at an end thereof, 2) a method of forming a crosslinked structure or a branched structure using a polyvalent metal ion in a polymer component having an ionic functional group at an end thereof, or 3) a method of extending a resin chain length and forming a branch by treatment with isocyanate or the like.

The toluene insoluble content represents a toner constituent component insoluble in toluene. That is, the toluene insoluble content is an insoluble content containing a component (particularly a polymer component in the binder resin) insoluble in toluene as a principal component (for example, 50% or more of the total).

The toluene insoluble content is a value measured by the following method.

In a weighed cylindrical filter paper made of glass fibers, 1 g of toner is placed, and the filter paper is mounted on an extraction tube of a heating-type Soxhlet extraction apparatus. Then, toluene is poured into a flask and heated to 110° C. by using a mantle heater. Also, the periphery of the extraction tube is heated to 125° C. by using a heater provided in the extraction tube. Extraction is performed at such a reflux speed that one extraction cycle is performed within a range of 4 minutes or more 5 minutes or less. After 10-hour extraction, the cylindrical filter paper and the toner residue are taken out, dried, and then weighed.

The amount of the toner residue (% by mass) is calculated based on a formula: amount of toner residue (% by mass) =[(amount of cylindrical filter paper+amount of toner residue) (g)−amount of cylindrical filter paper (g)]÷toner mass (g)×100. The calculated amount of the toner residue (% by mass) is regarded as the toluene insoluble content (% by mass).

The toner residue contains inorganic materials such as a coloring agent, the external additive, and the like, the polymer component of the binder resin, etc. When the toner particles contain a release agent, the release agent is a toluene soluble content because extraction is performed by heating.

The toner components according to the exemplary embodiment are described below.

(Toner Particle)

The toner particles include, for example, the binder resin, the release agent containing at least paraffin wax, and if required, the coloring agent and other additives.

—Binder Resin—

Both the amorphous resin and the crystalline resin are used for the binder resin. Using both the amorphous resin and the crystalline resin for the binder resin can achieve the excellent low-temperature fixability.

The amorphous resin represents a resin which has only a stepwise endothermic change, not a definite endothermic peak, in thermal analysis measurement using differential scanning calorimetry (DSC) and which is solid at room temperature and is thermally plasticized at a temperature equal to or higher than the glass transition temperature.

On the other hand, the crystalline resin represents a resin having a definite endothermic peak, not a stepwise endothermic change, in differential scanning calorimetry (DSC).

Specifically, for example, the crystalline resin represents a resin showing an endothermic peak having a half width of less than 10° C. in measurement at a heating rate of 10° C./min, and the amorphous resin represents a resin having a half width of over 10° C. or a resin not showing a definite endothermic peak.

The amorphous resin is described.

Examples of the amorphous resin include known resin materials such as styrene-acrylic resins, epoxy resins, polyester resins, polyurethane resins, polyamide resins, cellulose resins, polyether resins, polyolefin resins, and the like. An amorphous polyester resin is particularly preferred.

The amorphous polyester resin is described.

The amorphous polyester resin is, for example, a condensation polymer of a polyhydric carboxylic acid and a polyhydric alcohol. The amorphous polyester resin used may be a commercial product or a synthesized product.

Examples of the polyhydric carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphthalene dicarboxylic acid, the like), acid anhydrides thereof, and lower (for example, 1 to 5 carbon atoms) alkyl esters thereof. Among these, for example, aromatic dicarboxylic acids are preferred as the polyhydric carboxylic acid.

The polyhydric carboxylic acid may be a combination of dicarboxylic acid and a tri- or higher-hydric carboxylic acid having a crosslinked structure or branched structure. Examples of the tri- or higher-hydric carboxylic acid include trimellitic acid, pyromellitic acid, anhydrides thereof, lower (for example, 1 to 5 carbon atoms) alkyl esters thereof, and the like.

The polyhydric carboxylic acids may be used alone or in combination of two or more.

Examples of polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexane dimethanol, hydrogenated bisphenol A, and the like), and aromatic diols (for example, bisphenol A ethylene oxide adduct, bisphenol A propylene oxide adduct, and the like). Among these, for example, aromatic diols and alicyclic diols are preferred as the polyhydric alcohol, and the aromatic diols are more preferred.

The polyhydric alcohol may be a combination of diol and a tri- or higher-hydric alcohol having a crosslinked structure or branched structure. Examples of the tri- or higher-hydric alcohol include glycerin, trimethylolpropane, and pentaerythritol.

The polyhydric alcohols may be used alone or in combination of two or more.

The amorphous polyester resin preferably has a glass transition temperature (Tg) of 50° C. or more and 80° C. or less, and more preferably 50° C. or more and 65° C. or less.

The glass transition temperature is determined from a DSC curve obtained by differential scanning calorimetry (DSC). More specifically, the glass transition temperature is determined by "Extrapolation Glass Transition Onset Temperature" described in "Determination of Glass Transition Temperature" in JIS K 7121-1987 "Testing Methods for Transition Temperatures of Plastics".

The weight-average molecular weight (Mw) of the amorphous polyester resin is preferably 5,000 or more and 1,000,000 or less and more preferably 7,000 or more and 500,000 or less.

The number-average molecular weight (Mn) of the amorphous polyester resin is preferably 2,000 or more and 100,000 or less.

The molecular weight distribution Mw/Mn of the amorphous polyester resin is preferably 1.5 or more and 100 or less and more preferably 2 or more and 60 or less.

The weight-average molecular weight and number-average molecular weight are measured by gel permeation chromatography (GPC). The molecular weight is measured by GPC using GPC HLC-8120GPC manufactured by Tosoh Corporation as a measurement apparatus and a column TSK gel Super HM-M (15 cm) manufactured by Tosoh Corporation, and a THF solvent. The weight-average molecular weight and number-average molecular weight are calculated from the measurement results by using a molecular weight calibration curve formed by using monodisperse polystyrene standard samples.

The amorphous polyester resin can be produced by a known production method. Specifically, the polyester resin can be produced by, for example, a method in which reaction is performed at a polymerization temperature of 180° C. or more and 230° C. or less and, if required, under reduced pressure in the reaction system, while the water and alcohol produced during condensation are removed.

When a monomer used as a raw material is insoluble or incompatible at the reaction temperature, a solvent having a high boiling point may be added as a solubilizing agent for dissolution. In this case, polycondensation reaction is performed while the solubilizing agent is distilled off. When a monomer having low compatibility is present, the monomer having low compatibility may be previously condensed with an acid or alcohol to be polycondensed with the monomer having low compatibility, and then polycondensed with a principal component.

The crystalline resin is described.

Examples of the crystalline resin include polyester resins, crystalline vinyl resins, and the like, and a crystalline polyester resin is particularly preferred.

The crystalline polyester resin is described.

The crystalline polyester resin is, for example, a condensation polymer of a polyhydric carboxylic acid and a polyhydric alcohol. The crystalline polyester resin used may be a commercial product or a synthesized product.

The crystalline polyester resin is preferably a condensation polymer using a linear aliphatic polymerizable monomer rather than an aromatic polymerizable monomer in order to easily form a crystal structure.

Examples of the polyhydric carboxylic acid include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxlic acid, 1,14-tetradecanedicarboxlic acid, 1,18-octadecanedicarboxylic acid, and the like), aromatic dicarboxylic acids (for example, phthalic acid, isophthalic acid, terephthalic acid, naphthalene-2,6-dicarboxylic acid, the like), acid anhydrides thereof, and lower (for example, 1 to 5 carbon atoms) alkyl esters thereof.

The polyhydric carboxylic acid may be a combination of dicarboxylic acid and a tri- or higher-hydric carboxylic acid having a crosslinked structure or branched structure. Examples of the tri- or higher-hydric carboxylic acid include aromatic carboxylic acids (for example, 1,2,3-benzenetricarboxylic acid, 1,2,4-benzenetricarbboxylic acid, 1,2,4-naphthalenetricarboxylic acid, and the like), anhydrides thereof, lower (for example, 1 to 5 carbon atoms) alkyl esters thereof, and the like.

The polyhydric carboxylic acids may be a combination of dicarboxylic acid and a dicarboxylic acid having a sulfonic acid group and a dicarboxylic acid having an ethylenic double bond.

The polyhydric carboxylic acids may be used alone or in combination of two or more.

Examples of polyhydric alcohol include aliphatic diols (for example, liner aliphatic diols having a main chain part having 7 or more and 20 or less carbon atoms). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanediol, and the like. Among these, 1,8-octanediol, 1,9-nonanediol, and 1,10-decanediol are preferred as the aliphatic diols.

The polyhydric alcohol may be a combination of diol and a tri- or higher-hydric alcohol having a crosslinked structure or branched structure. Examples of the tri- or higher-hydric alcohol include glycerin, trimethylolethane, trimethylolpropane, pentaerythritol, and the like.

The polyhydric alcohols may be used alone or in combination of two or more.

The content of the aliphatic diol as the polyhydric alcohol is 80 mol % or more and preferably 90 mol % or more.

The crystalline polyester resin preferably has a melting temperature of 50° C. or more and 100° C. or less, more preferably 55° C. or more and 90° C. or less, and still more preferably 60° C. or more and 85° C. or less.

The melting temperature is determined from a DSC curve obtained by differential scanning calorimetry (DSC) according to "Melting Peak Temperature" described in "Determination of Melting Temperature" in JIS K 7121-1987 "Testing Methods for Transition Temperatures of Plastics".

The weight-average molecular weight (Mw) of the crystalline polyester resin is preferably 6,000 or more and 35,000 or less.

The weight-average molecular weight and number-average molecular weight are measured by gel permeation chromatography (GPC) according to the same method as for the amorphous polyester resin.

The crystalline polyester resin can be produced by, for example, the same known production method as for the amorphous polyester resin.

The content of the crystalline resin is, for example, preferably 3% by mass or more 20% by mass or less and more preferably 5% by mass or more and 15% by mass or less relative to the total amount of toner particles.

—Release Agent—

A paraffin wax having a melting temperature of 60° C. or more and 80° C. or less is used as the release agent. The release agent having a melting temperature of 80° C. or less can exhibit excellent low-temperature fixability, while the melting temperature of 60° C. or more can increase the storage stability of the toner.

Examples of the paraffin wax include polyethylene wax, polypropylene wax, and the like.

The melting temperature of the paraffin wax is preferably 65° C. or more and 78° C. or less and more preferably 65° C. or more and 75° C. or less.

The melting temperature is determined from a DSC curve obtained by differential scanning calorimetry (DSC) according to "Melting Peak Temperature" described in "Determination of Melting Temperature" in JIS K 7121-1987 "Testing Methods for Transition Temperatures of Plastics".

The content of the release agent is, for example, preferably 1% by mass or more 20% by mass or less and more preferably 5% by mass or more and 15% by mass or less relative to the total of toner particles.

The release agent may contain a release agent (also referred to as "another release agent" hereinafter) other than the paraffin wax.

Examples of the other release agent include paraffin wax having a melting temperature of less than 60° C. or over 80° C., hydrocarbon wax other than paraffin wax; natural wax such as carnauba wax, rice bran wax, candelilla wax, and the like; synthetic or mineral/petroleum wax such as montan wax and the like; ester-based wax such as fatty acid esters, montanic acid esters, and the like, and the like.

When the release agent contains the other release agent, the content of paraffin wax having a melting temperature of 60° C. or more and 80° C. or less is preferably over 50% by mass and more preferably 60% by mass or more relative to the whole of the release agents.

—Absolute Value of Difference between Melting Temperature of Crystalline Resin and Melting Temperature of Paraffin Wax—

The toner particles according to the exemplary embodiment contain the crystalline resin and the paraffin wax (release agent) having a melting temperature of 60° C. or more and 80° C. or less, and the absolute value of difference between the melting temperature of the crystalline resin and the melting temperature of the paraffin wax is 10° C. or less.

The absolute value of the difference is preferably 8° C. or less and more preferably 5° C. or less.

When the absolute value of the difference is 10° C. or less, excellent fixability can be achieved.

In addition, the absolute value of the difference is preferably as small as possible.

—Coloring Agent—

Examples of the coloring agent include various pigments such as carbon black, chrome yellow, hansa yellow, benzidine yellow, threne yellow, quinoline yellow, pigment yellow, permanent orange GTR, pyrazolone orange, Vulcan orange, watch young red, permanent red, brilliant carmine 3B, brilliant carmine 6B, DuPont oil red, pyrazolone red, lithol red, rhodamine B late, lake red C, pigment red, rose Bengal, aniline blue, ultramarine blue, calco oil blue, methylene blue chloride, phthalocyanine blue, pigment blue, phthalocyanine green, malachite green oxalate, and the like; various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, thiazole dyes, and the like.

The coloring agents may be used alone or in combination of two or more.

If required, the coloring agent may be surface-treated or used in combination with a dispersant. Also, plural types of coloring agents may be used.

The content of the coloring agent is, for example, preferably 1% by mass or more 30% by mass or less and more preferably 3% by mass or more and 15% by mass or less relative to the total of toner particles.

—Other Additives—

Examples of other additives include known additives such as a magnetic material, a charging control agent, an inorganic power, and the like. These additives are contained as internal additives in the toner particles.

—Volume-Average Particle Diameter of Toner Particles—

The volume-average particle diameter of the toner particles is 6 μm or more and 9 μm or less.

The volume-average particle diameter of the toner particles is preferably 6.5 μm or more and 8 μm or less and more preferably 6.5 μm or more and 7.5 μm or less. The toner particles having a volume-average particle diameter of 6 μm or more can exhibit production suitability for production by a pulverizing method. On the other hand, the average particle diameter of 9 μm or less facilitates the formation of a high-quality image.

The volume-average particle diameter of the toner particles is measured by using COULTER MULTISIZER II (manufactured by Beckman Coulter Inc.) and ISOTON-II (manufactured by Beckman Coulter Inc.) as an electrolyte.

In measurement, 0.5 mg or more and 50 mg or less of a measurement sample is added to 2 ml of a 5% aqueous solution of a surfactant (sodium alkylbenzenesulfonate) used as a dispersant. The resultant mixture is added to 100 ml or more and 150 ml or less of the electrolyte.

The electrolyte in which the sample is suspended is dispersed by an ultrasonic disperser for 1 minute and a particle size distribution of particles having particle diameters within a range of 2 μm or more and 60 μm or less is measured by COULTER MULTISIZER II using an aperture having an aperture diameter of 100 μm. The number of particles sampled is 50,000.

The measured particle size distribution is divided into particle size ranges (channels), and a volume-based cumulative distribution from the small-diameter side is formed. The cumulative 50% particle diameter is defined as volume-average particle diameter D50v.

—Shape Factor SF1 of Toner Particles—

The shape factor SF1 of the toner particles is 140 or more. When the shape factor SF1 of the toner particles is 140 or more, production suitability for production by a pulverizing method is obtained.

The shape factor SF1 of the toner particles is preferably 141 or more, more preferably 143 or more, and still more preferably 145 or more. From the viewpoint of facilitating the formation of a high-quality image due to the shape relatively close to a spherical shape, the upper limit is preferably 155 or less, more preferably 153 or less, and still more preferably 151 or less.

The toner particles having a shape factor SF1 of 140 or more are generally produced by a pulverizing method such as a kneading/pulverizing method.

For example, the toner particles produced by the kneading/pulverizing method have an irregular shape, but the cleaning properties are improved by combining with the image forming apparatus provided with the cleaning unit described above.

A method for producing the toner particles by the kneading/pulverizing method is described later.

The shape factor SF1 of the toner particles is determined by formula (1) below.

$$SF1=(ML^2/A)\times(\pi/4)\times 100 \quad \text{Formula (1):}$$

In the formula (1), ML is the absolute maximum length of toner particles, and A is a projected area of toner particles.

Specifically, an image of a scanning electron microscope (SEM) is quantified by analysis using an image analyzer, and the shape factor SF is calculated as follows: A microscope image of particles scattered on the surface of a slide glass is input to a LUZEX image analyzer through a video camera, and the maximum length and projected area of each of 100 particles are determined. SF1 of each of the particles is calculated by the formula (1), and the average value of 100 particles is determined.

For example, when the toner particles are produced by the kneading/pulverizing method, the shape factor SF1 of the toner particles can be controlled by adjusting a control parameter of a pulverizing/classification equipment.

(External Additive)

The external additive is, for example, inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, and the like.

Among the inorganic particles, $SiO_2$ (silica) and $TiO_2$ (titania) are more preferred as the external additive.

The surfaces of the inorganic particles used as the external additive may be hydrophobized. Hydrophobization is performed by, for example, dipping the inorganic particles in a hydrophobizing agent. Examples of the hydrophobizing agent include, but are not particularly limited to, a silane coupling agent, silicone oil, titanate coupling agent, an aluminum coupling agent, and the like. These may be used alone or in combination of two or more.

The amount of the hydrophobizing agent is generally, for example, 1 part by mass or more and 10 parts by mass or less relative to 100 parts by mass of the inorganic particles.

Other examples of the external additive include resin particles (resin particles of polystyrene, polymethyl methacrylate (PMMA), melamine resin, and the like), a cleaning active agent (for example, a higher fatty acid metal salt such as zinc stearate, particles of a fluorine-based polymer), and the like.

The amount of the external additive added is, for example, preferably 0.01% by mass or more and 5% by mass or less and more preferably 0.01% by mass or more and 2.0% by mass or less relative to the toner particles.

From the viewpoint of more improving the cleaning properties, external additives having different volume-average particle diameters are used as the external additive. Specifically, it is preferred to use at least two types of external additives, for example, including medium-diameter particles having a volume-average particle diameter of 10 nm or more and 100 nm or less (preferably, 20 nm or more and 80 nm or less) and large-diameter particles having a volume-average particle diameter of 50 nm or more and 250 nm or less (preferably, 80 nm or more and 200 nm or less).

In this case, the medium-diameter particles are preferably the inorganic particles (more preferably, silica particles or titania particles), and the surface of the medium-diameter particles are preferably treated with oil such as silicone oil or the like.

By containing the medium-diameter particles as the external additive, the external additive dam can be easily formed by the external additive separated from the toner.

The large-medium particles are preferably the inorganic particles.

By containing the large-diameter particles as the external additive, the posture of the cleaning blade is easily stabilized. Thus, the external additive dam is easily stably formed.

Therefore, the cleaning properties are further improved by using at least two types of external additives having different volume-average particle diameters as the external additive.

The mass ratio (medium-diameter particles/large-diameter particles) of the content of medium-diameter particles to the content of large-diameter particles is preferably 0.4 or more and 4.0 or less, more preferably 0.6 or more and 3.5 or less, and still more preferably 0.8 or more and 3.0 or less.

(Method for Producing Toner)

Next, a method for producing the toner according to the exemplary embodiment is described.

The toner according to the exemplary embodiment is produced by producing the toner particles and then adding the external additive to the toner particles.

As described above, the toner particles according to the exemplary embodiment are toner particles having an irregular shape (that is, with a shape factor SF1 of 140 or more). The toner particles are generally produced by a pulverizing method such as a kneading/pulverizing method.

The kneading/pulverizing method is a method of melt kneading the binder resin and the release agent containing at least paraffin wax having a melting temperature within the range described above, and then pulverizing and classifying the resultant kneaded product. Specifically, the kneading/pulverizing method includes, for example, melt-kneading the binder resin and the release agent, cooling the resultant melt-kneaded product, pulverizing the kneaded product after cooling, and classifying the pulverized product.

Each of the processes of the kneading/pulverizing method is described in detail below.

—Kneading—

A resin particle forming material containing the binder resin and the release agent is melt-kneaded.

Examples of a kneader used for kneading include a three-roll type, a uniaxial screen type, a biaxial screen type, and a BANBURY mixer type.

The melting temperature may be determined according to the types and mixing ratios of the binder resin and release agent kneaded.

—Cooling—

The kneaded product formed by kneading is cooled.

In order to maintain a dispersion state immediately after the completion of kneading, cooling is performed from the temperature of the kneaded product at the end of kneading to 40° C. or less at an average cooling rate of 4° C./sec or more.

The average cooling rate represents an average value of the rate of cooling from the temperature of the kneaded product at the end of kneading to 40° C.

Specifically, a cooling method include, for example, a method using a rolling roll and an insertion-type cooling belt in which cooling water or brine is circulated. In cooling by the cooling method, the cooling rate is determined by the speed of the cooling roll, the flow rate of brine, the amount of the kneaded product supplied, the thickness of a slab during rolling of the kneaded product, or the like. The thickness of a slab is as thin as 1 mm or more and 3 mm or less.

—Pulverizing—

The kneaded product cooled is pulverized to form particles.

Pulverizing is performed by, for example, using a mechanical pulverizer, a jet-type pulverizer, or the like.

—Classification—

If required, the pulverized product (particles) produced by pulverizing may be classified for producing the toner particles having a volume-average particle diameter of 6 μm or more and 9 μm or less.

In classification, a fine powder (particles smaller than a particle diameter within the intended range) and coarse powder (particles larger than a particle diameter within the intended range) are removed by using a usually used centrifugal classifier or inertial classifier, or the like.

The toner particles having a shape factor SF1 of 140 or more and a volume-average particle diameter of 6 μm or more and 9 μm or less can be produced through the processes described above.

The toner particles are produced by the processes described above.

The toner according to the exemplary embodiment is produced by, for example, adding the external additive to the resultant toner particles in a dry state and mixing the resultant mixture. Mixing may be performed by, for example, using a V blender, a HENSHEL mixer, a Lodige mixer, or the like. If required, the coarse particles may be further removed by using a vibration screen classifier, a wind-power screen classifier, or the like.

<Electrostatic Image Developer>

The electrostatic image developer according to the exemplary embodiment contains at least the toner according to the exemplary embodiment.

The electrostatic image developer according to the exemplary embodiment may be a one-component developer containing only the toner according to the exemplary embodiment or a two-component developer containing a mixture of the toner and a carrier.

The carrier is not particularly limited and is, for example, a known carrier. Examples of the carrier include a coated carrier containing a magnetic powder core surface-coated with a coating resin, a magnetic powder-dispersed carrier containing a matrix resin in which a magnetic powder is dispersed and mixed, a resin-impregnated carrier containing a porous magnetic powder impregnated with a resin, and the like.

The magnetic powder-dispersed carrier and the resin-impregnated carrier may be a carrier which contains constituent particles of the carrier as a core and which is coated with a coating resin.

Examples of the magnetic powder include powders of magnetic metals such as iron, nickel, cobalt, and the like, magnetic oxides such as ferrite, magnetite, and the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, a straight silicone resin containing an organosiloxane bond and modified products thereof, a fluorocarbon resin, polyester, polycarbonate, phenol resins, epoxy resins, and the like.

The coating resin and the matrix resin may contain other additive such as conductive particles and the like.

Examples of the conductive particles include particles of metals such as gold, silver, copper, and the like, carbon black, titanium oxide, zinc oxide, tin oxide, barium sulfate, aluminum borate, potassium titanate, and the like.

The surface of the core can be coated with the coating resin by a method of coating with a coating layer-forming solution prepared by dissolving the coating resin, and if required, various additives in a proper solvent. The solvent is not particularly limited and is selected in consideration of the coating resin used, coatability, and the like.

Examples of a resin coating method include a dipping method of dipping the core in the coating layer-forming solution, a spray method of spraying the coating layer-forming solution to the core surface, a fluidized bed method of spraying the coating layer-forming solution to the core in a state being floated by flowing air, a kneader/coater method of mixing the core of the carrier and the coating layer-forming solution in a kneader/coater and removing the solvent, and the like.

The mixing ratio (mass ratio) between the toner and the carrier in a two-component developer is preferably toner: carrier=1:100 to 30:100 and more preferably 3:100 to 20:100.

The image forming apparatus according to the exemplary embodiment is described above by giving an example with reference to the drawings, but the exemplary embodiment is not limited to this example.

EXAMPLES

The exemplary embodiment of the present invention is described in further detail below by giving examples and comparative examples, but the exemplary embodiment is not limited to these examples.

<Formation of Crystalline Resin (A)>

First, in a three-neck flask, 100 parts by mass of dimethyl sebacate, 67.8 parts by mass of hexanediol, 0.10 parts by mass of dibutyltin oxide are reacted at 185° C. for 5 hours in a nitrogen atmosphere while the water produced during reaction is removed to the outside of the system, and then the temperature is increased to 220° C. while the pressure is slowly decreased. At the temperature, reaction is performed for 6 hours, followed by cooling. As a result, a crystalline resin (A) having a weight-average molecular weight of 33,700 is prepared.

The melting temperature of the crystalline resin (A) is determined from a DSC curve obtained by differential scanning calorimetry (DSC) according to "Melting Peak Temperature" described in "Determination of Melting Temperature" in JIS K 7121-1987 "Testing Methods for Transition Temperatures of Plastics". As a result, the melting temperature is 71° C.

<Formation of Amorphous Resin (1)>

In a three-neck flask, 61 parts by mass of dimethyl terephthalate, 75 parts by mass of dimethyl fumarate, 34 parts by mass of dodecenylsuccinic anhydride, 16 parts by mass of trimellitic acid, 137 parts by mass of bisphenol A ethylene oxide adduct, 191 parts by mass of bisphenol A propylene oxide adduct, and 0.3 parts by mass of dibutyltin oxide are reacted at 180° C. for 3 hours in a nitrogen atmosphere while the water produced during reaction is removed to the outside of the system, and then the temperature is increased to 240° C. a while the pressure is slowly decreased. At the temperature, reaction is performed for 2 hours, followed by cooling. As a result, an amorphous resin (1) having a weight-average molecular weight of 17,100 is prepared.

<Formation of Amorphous Resin (2)>

An amorphous resin (2) is produced by the same method as production of the amorphous resin (1) except that 60 parts by mass of dimethyl terephthalate, 74 parts by mass of dimethyl fumarate, 30 parts by mass of dodecenylsuccinic anhydride, and 22 parts by mass of trimellitic acid are used. The weight-average molecular weight of the amorphous resin (2) is 17,500.

<Formation of Amorphous Resin (3)>

An amorphous resin (3) is produced by the same method as production of the amorphous resin (1) except that 60 parts by mass of dimethyl terephthalate, 70 parts by mass of dimethyl fumarate, 29 parts by mass of dodecenylsuccinic anhydride, and 29 parts by mass of trimellitic acid are used. The weight-average molecular weight of the amorphous resin (3) is 16,600.

<Formation of Amorphous Resin (4)>

An amorphous resin (4) is produced by the same method as production of the amorphous resin (1) except that 55 parts by mass of dimethyl terephthalate, 64 parts by mass of dimethyl fumarate, 27 parts by mass of dodecenylsuccinic anhydride, and 46 parts by mass of trimellitic acid are used. The weight-average molecular weight of the amorphous resin (4) is 15,100.

Example 1

<Formation of Toner (1)>

In a HENSHEL mixer (manufactured by Nippon Coke & Engineering Co., Ltd.), 79 parts by mass of the amorphous resin (1), 7 parts by mass of a coloring agent (C.I. Pigment Blue 15:1), 5 parts by mass of a release agent (paraffin wax, melting temperature of 73° C., manufactured by Nippon Seiro Co., Ltd.), and 8 parts by mass of the crystalline resin (A) (melting temperature: 71° C.) are placed and stirred and mixed at a circumferential speed 15 m/sec for 5 minutes. Then, the resultant stirred mixture is melt-kneaded by an extruder-type continuous kneader.

The set conditions of the extruder include a supply-side temperature of 160° C., a discharge-side temperature of 130° C., a cooling roll supply-side temperature of 40° C., and a cooling roll discharge-side temperature of 25° C. The temperature of the cooling belt is set to 10° C.

The resultant melt-kneaded product is cooled, then coarsely pulverized by using a hammer mill, next finely pulverized to 6.5 μm by using a jet mill (manufactured by Nippon Pneumatic Mfg. Co., Ltd.), and further classified by using an elbow-jet classifier (manufactured by Nittetsu Mining Co., Ltd., model: EJ-LABO) to produce toner particles (1).

The toner particles (1) have a volume-average particle diameter of 6.9 μm and a SF1 of 145.

The volume-average particle diameter and SF1 are measured according to the methods described above. The results are shown in Table 1. The same applies hereinafter.

In a HENSHEL Mixer (manufactured by Mitsui Miike Machinery Co., Ltd.), 100 parts by mass of the toner particles (1) and 1.2 parts by mass of commercial fumed silica RX50 (manufactured by Nippon Aerosil Co., Ltd.) are mixed under the condition of a circumferential speed of 30 m/s for 5 minutes to produce a toner (1).

Example 2

<Formation of Toner (2)>

Toner particles (2) are produced by the same method as in Example 1 except that the amorphous resin (2) is used in place of the amorphous resin (1).

The toner particles (2) have a volume-average particle diameter of 6.8 μm and a SF1 of 147.

A toner (2) is produced by the same method as for the toner (1) except that the toner particles (2) are used.

Example 3

<Formation of Toner (3)>

Toner particles (3) are produced by the same method as in Example 1 except that the amorphous resin (3) is used in place of the amorphous resin (1).

The toner particles (3) have a volume-average particle diameter of 7.0 μm and a SF1 of 149.

A toner (3) is produced by the same method as for the toner (1) except that the toner particles (3) are used.

Example 4

<Formation of Toner (4)>

Toner particles (4) are produced by the same method as in Example 1 except that the amorphous resin (4) is used in place of the amorphous resin (1).

The toner particles (4) have a volume-average particle diameter of 7.3 μm and a SF1 of 151.

A toner (4) is produced by the same method as for the toner (1) except that the toner particles (4) are used.

Comparative Example 1

<Formation of Toner (1C)>

Toner particles (1C) are produced by the same method as in Example 1 except that paraffin wax (manufactured by Nippon Seiro Co., Ltd., HNP9, melting temperature 77° C.) is used in place of the paraffin wax used in Example 1.

The toner particles (1C) have a volume-average particle diameter of 7.0 μm and a SF1 of 146.

A toner (1C) is produced by the same method as for the toner (1) except that the toner particles (1C) are used.

<Measurement of Toluene Insoluble Content>

The toluene insoluble content of each of the toners produced in the examples is measured according to the method described above. The results are shown in Table 1.

<Production of Developer>

A two-component developer of each of the examples is produced by mixing 8 parts by mass of the toner produced in each of the examples and 100 parts by mass of a carrier.

The carrier is produced by using 100 parts by mass of ferrite particles (volume-average particle diameter: 50 μm), 14 parts by mass of toluene, and 2 parts by mass of styrene-methyl methacrylate copolymer (component ratio: styrene/methyl methacrylate=90/10, weight-average molecular weight Mw=80,000). First, the components excluding the ferrite particles are stirred and dispersed by using a stirrer for 10 minutes to prepare a coating solution. Next, the coating solution and the ferrite particles are placed in a vacuum deaeration-type kneader (manufactured by Inoue Mfg. Inc.), stirred at 60° C. for 30 minutes, further deaerated by decreasing the pressure under heating, dried, and then sieved with 105 μm.

[Evaluation]

APEOS PORT VC7780 manufactured by Fuji Xerox Co., Ltd. is prepared as an image forming apparatus. A developer containing each of the toners (1) to (4) and (1C) is housed in a developing device of the image forming apparatus, and the image forming apparatus is used as an image forming apparatus of each of Examples 1 to 4 and Comparative Example 1.

The image forming apparatus of each of Examples 1 to 4 is provided with a cleaning unit including the damming member and the cleaning blade. A damming member shown in FIG. 3 is used.

—Contact Area of Toner Deposit on Surface of Photoreceptor—

After the evaluation of image defects, the contact area of the toner deposit on the photoreceptor is calculated by visually observing the toner deposit remaining on the photoreceptor. A larger contact area indicates a larger amount of toner deposit remaining on the photoreceptor. This indicates the good cleaning properties. The results are shown in Table 1.

TABLE 1

| | Toner | Melting temperature of binder resin A [° C.] | Melting temperature of paraffin wax B [° C.] | Difference in melting temperature \|A − B\| [° C.] | Volume-average particle diameter [nm] | Shape factor SF1 | Toluene insoluble content [% by mass] | Damming member | Evaluation of Cleaning properties: Image defect | Filming | Contact area [mm$^2$] |
|---|---|---|---|---|---|---|---|---|---|---|---|
| Example 1 | (1) | 71 | 73 | 2 | 6.9 | 145 | 25 | Yes | A | A | 13.8 |
| Example 2 | (2) | 71 | 73 | 2 | 6.8 | 147 | 31 | Yes | A | A | 16.6 |
| Example 3 | (3) | 71 | 73 | 2 | 7.0 | 149 | 38 | Yes | A | A | 18.1 |
| Example 4 | (4) | 71 | 73 | 2 | 7.3 | 151 | 45 | Yes | A | A | 19.8 |
| Comparative Example 1 | (1C) | 71 | 77 | 6 | 7.0 | 146 | 20 | No | C | C | 1.6 |

The image forming apparatus of Comparative Example 1 is provided with a cleaning unit without the damming member.

The end of the cleaning blade is brought into contact with the photoreceptor faces in a direction opposite to the rotational direction of the photoreceptor. The cleaning blade is disposed at an angle θ of 23° and a pressing pressure N of 2.6 gf/mm$^2$.

Also, when an image is formed, the rotational speed of the surface of the photoreceptor is 320 mm/sec, and the fixing temperature by a fixing unit is 165° C.

<Cleaning Properties>

—Image Defect Due to Cleaning Failure—

An entire-surface half-tone image with an image density of 40% is output on 10,000 sheets by using A4-size paper (manufactured by Fuji Xerox Co., Ltd., C2 paper) in a high-temperature-high-humidity environment (temperature 28° C., humidity 85% RH), and then an entire-surface half-tone image with an image density of 20% is output on 10,000 sheets in the same environment.

Then, the presence of image defects (stripes) due to cleaning failure is visually observed by using the entire-surface half-tone image with an image density of 20%, and image defects are evaluated according to criteria below. An allowable range is from B. The results are sown in Table 1.

—Evaluation Criteria—

A: No occurrence of stripes due to cleaning failure

B: Occurrence of slight stripes due to cleaning failure

C: Occurrence of stripes causing an image problem

—Filming Due to Cleaning Failure—

After the evaluation of image defects, the presence of filming is confirmed by visually observing the surface of the photoreceptor, and filming is evaluated according to criteria below. An allowable range is from B. The results are shown in Table 1.

—Evaluation Criteria—

A: No occurrence of filming on the photoreceptor

B: Occurrence of filming on the photoreceptor without occurrence of stripes as image defects C: Occurrence of filming causing an image problem The results described above indicate that the examples have good cleaning properties as compare with the comparative example.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges the surface of the image holding member;

an electrostatic image forming unit that forms an electrostatic image on the surface of the charged image holding member;

a development unit that contains an electrostatic image developer containing a toner for an electrostatic image development and develops a toner image on the surface of the image holding member;

a transfer unit that transfers the toner image to a recording medium;

a fixing unit that fixes the toner image to the recording medium; and a cleaning unit including a cleaning blade and a member that dams the toner for electrostatic image development scraped from the surface of the image holding member and that stores the toner on the upstream side of a contact position between the cleaning blade and the image holding member in the rotational direction of the image holding member, wherein the toner for electrostatic image development contains a binder resin containing an amorphous resin and a crystalline resin, and paraffin wax;

the toner has a volume-average particle diameter of 6 μm to 9 μm, a shape factor SF1 of 140 or more, and a toluene insoluble content within a range of 30% to 40%;

the melting temperature of the paraffin wax is 60° C. or more and 80° C. or less; and the absolute value of difference between the melting temperature of the crystalline resin and the melting temperature of the paraffin wax is 10° C. or less.

2. The image forming apparatus according to claim 1, wherein the melting temperature of the paraffin wax is within a range of 65° C. to 78° C.

3. The image forming apparatus according to claim 1, wherein the melting temperature of the paraffin wax is within a range of 65° C. to 75° C.

4. The image forming apparatus according to claim 1, wherein the toluene insoluble content in the toner is 30% or more and 38% or less.

5. The image forming apparatus according to claim 1, wherein the toluene insoluble content in the toner is 30% or more and 35% or less.

6. The image forming apparatus according to claim 1, wherein the absolute value of difference between the melting temperature of the crystalline resin and the melting temperature of the paraffin wax is 5° C. or less.

7. The image forming apparatus according to claim 1, wherein the crystalline resin is polyester.

8. The image forming apparatus according to claim 1, wherein the content of the crystalline resin in the toner is within a range of 3% to 20% by weight.

9. The image forming apparatus according to claim 1, wherein the content of the crystalline resin in the toner is within a range of 5% to 15% by weight.

* * * * *